United States Patent [19]

Shindo et al.

[11] 4,383,006

[45] May 10, 1983

[54] HOT-DIP GALVANIZED STEEL SHEET WITH ZERO-SPANGLE HAVING EXCELLENT AGE-FLAKING RESISTANCE, AND HOT-DIP GALVANIZING PROCESS AND COMPOSITION OF MOLTEN ZINC BATH THEREFOR

[75] Inventors: Yoshio Shindo; Teppei Tamura, both of Kisarazu; Motoo Kabeya; Mitsumasa Nagahisa, both of Kimitsu; Hidejirou Asano, Tokyo, all of Japan

[73] Assignee: Nippon Steel Corporation, Japan

[21] Appl. No.: 281,505

[22] Filed: Jul. 8, 1981

[30] Foreign Application Priority Data

Jul. 18, 1980 [JP] Japan ..... 55-98251

[51] Int. Cl.[3] ..... B32B 15/18; C22C 18/04

[52] U.S. Cl. ..... 428/659; 420/514; 427/433

[58] Field of Search ..... 75/178 A; 427/433; 428/659

[56] References Cited

U.S. PATENT DOCUMENTS 4,056,366 11/1977 Lee et al. ..... 428/659 X 4,056,657 11/1977 Leckie et al. ..... 428/659

*Primary Examiner*—L. Dewayne Rutledge

*Assistant Examiner*—David Hey

*Attorney, Agent, or Firm*—Wenderoth, Lind & Ponack

[57] ABSTRACT

Hot-dip galvanized steel sheet, wherein said coating layer is characterized by being highly resistant to flaking either in a high-temperature humid atmosphere or in long-term indoor aging. The coating comprises 0.1 to less than 0.2 wt % Al, 0.1–0.5 wt % Sb, the remainder being Zn and unavoidable impurities, the total of the unavoidable impurities other than Fe, namely Pb, Cd and Sn being less than 0.02 wt %, the ratio of Sb/Pb being 10–250, and the Al present in the coating layer being in the form of an Al-Sb eutectic.

13 Claims, 4 Drawing Figures

HOT-DIP GALVANIZED STEEL SHEET WITH ZERO-SPANGLE HAVING EXCELLENT AGE-FLAKING RESISTANCE, AND HOT-DIP GALVANIZING PROCESS AND COMPOSITION OF MOLTEN ZINC BATH THEREFOR

BACKGROUND OF THE INVENTION

A. Field of the Invention

The present invention relates to a galvanized steel sheet with a zero-spangle, a galvanizing process therefor, and a composition of a molten zinc bath therefor. More specifically, this invention is directed to a method for preventing the flaking off or peeling of the zinc coating of a hot-dip galvanized steel sheet (referred to galvanized steel sheet hereinafter) which is apt to occur when the galvanized steel sheet is subjected to working after it has been stored indoor over a long period as the result of transgranular fracture caused by corrosion and the propagation of slow cracks in the galvanized coating during the long indoor storage period.

The term "Zero-spangle" used throughout in this specification refers to a minimum spangle which is much finer than a large spangle.

B. Description of the Prior Art

Galvanized steel sheet is one of the most extensively manufactured coated steel sheets at the present time and it is in strong demand in many fields of industry for automobiles, building, electric home appliances, and the like. Recently, the advent of complicated and diversified uses and remarkable progress in both painting and film adhesion techniques has, together with the trend toward complicated forms of fabrication, given rise to an urgent need for a surface treated steel sheet of a much higher quality than has been available up to now.

On the other hand, it is recently often noted that when a painted galvanized steel sheet or a galvanized steel sheet coated with vinyl chloride is used under conditions where it is exposed to the weather or to a high temperature humid atmosphere, there occurs blistering or peeling of the coated layer together with the coating in the form of spots or flakes due to intergranular corrosion. This greatly reduces the commercial value of the galvanized steel sheet as a surface-treated steel sheet product.

As a countermeasure to the above described defect, it has already been proposed that instead of a molten zinc coating, there be used a method of adding 0.02–0.15 wt% Sb (wt stands for weight) to an alloy of Zn and 0.2–17 wt% Al. As an example in which Sb is added to a molten zinc bath in order to improve both phosphate treatment and paint adherence of a high Pb galvanized steel sheet, there is known a method wherein 0.01–0.50 wt% Sb is added to the hot-dip zinc bath.

In addition to the flaking of a coating layer resulting from grain boundary corrosion in a high temperature humid atmosphere, the present inventors have seen the coating layer of a galvanized steel sheet flake off when exposed to an ordinary indoor atmosphere. They carried out research to determine the cause of the phenomenon. Their findings are as follows:

The coating layers of both painted galvanized steel sheet and galvanized steel sheet coated with vinyl chloride will flake off after an indoor aging period of more than one year from the time of galvanizing, even when not exposed to a high temperature humid atmosphere (95° C., RH>98%), at the time the sheet is subjected to working.

As regards the flaking-off of a coating layer as described above, it is seen that the finer the spangle on the surface of a galvanized steel sheet the more the flaking of the coating layer tends to occur. The commonly used coating layer having a large spangle resists flaking off.

From the above findings, the inventors have concluded that the chief cause for flaking off of a coating layer is the composition of the galvanizing bath or a difference in the nature of the coating layer. They, therefore conducted a study on the cause and obtained the following results:

It was concluded that the occurrence of peeling of a coating layer in the case where a galvanized steel sheet is subjected to working after being left to stand for a long period in a weak corrosive environment is due to transgranular fracture caused by the slow enlargement and propagation of cracks which occur at the time of production of a minimum spangle by rapid cooling, with corrosion being another contributing factor. On the other hand, in a high-temperature humid atmosphere, flaking of the coating layer accompanies the progress of grain boundary corrosion.

A crack which developed in a coating layer with a zero-spangle after the galvanized steel sheet had been stored for a long period was analyzed by an X-ray microanalyzer (referred to as an EMX hereinafter). From the analysis it was concluded that both Al and O had been concentrated to produce an anchor effect.

On analyzing the elements which remained at the side of the steel sheet in the flaking region by EMX, it was found that there was little Zn and much Fe and Al. Hence, it is seen that flaking of a coating layer finally takes place in the vicinity of a Fe-Al-Zn ternary alloy.

In other words, one of the causes in connection with flaking of a coating layer which occurs concentratedly in zero-spangle galvanized steel sheet lies in the occurrence of a crack in the coating layer resulting from the rapid cooling applied to the surface of the coating layer when it is in a semi-molten state.

The second cause is that when the galvanized steel sheet stands in storage for a long time, water adsorbed on the surface of the coating finds its way through the cracks into interior regions of the coating, selective corrosion of segregated Al in the coating layer occurs, and the corrosive atmosphere of the crack is increased in alkalinity by the corrosion product.

Further, it appears that the hydrogen gas, etc. generated at the cathode in this corrosive reaction produces a swelling effect which continues as the coating layer gradually embrittles, eventually to flake off from the Fe-Al-Zn ternary alloy layer.

On the basis of their observations, the inventors directed their efforts toward attaining the three items (1)–(3) mentioned below with a view to preventing the flaking of the coating layer of a galvanized steel sheet with a zero-spangle during long-term indoor aging and, as a result, accomplished the present invention:

(1) To make possible the selective formation of coating spangles using the same coating bath;
(2) To prevent generation of cracks in the coating layer even in the case where quenching treatment is carried out in order to make the spangle fine; and
(3) To inhibit the corrosive reaction of Al segregated in the grain boundary or liberated in the coating layer.

SUMMARY OF THE INVENTION

It is a principal object of the invention to provide a galvanized steel sheet in which no flaking nor peeling of the coating layer occurs as a result of grain boundary corrosion in a high temperature humid atmosphere.

It is another object of the invention to provide a galvanized steel sheet with a zero-spangle in which no flaking nor peeling of the coating layer takes place even during a long-term indoor aging.

It is still another object of the invention to provide a method of galvanizing a steel sheet having the above feature.

It is an additional object of the invention to provide a composition for a molten coating bath for the above galvanizing method.

BRIEF DESCRIPTION OF THE DRAWINGS

Other and further objects of the invention will be better understood in the following description with reference to the accompanying drawings, in which.

DETAILED DESCRIPTION OF THE INVENTION

Figure 1:
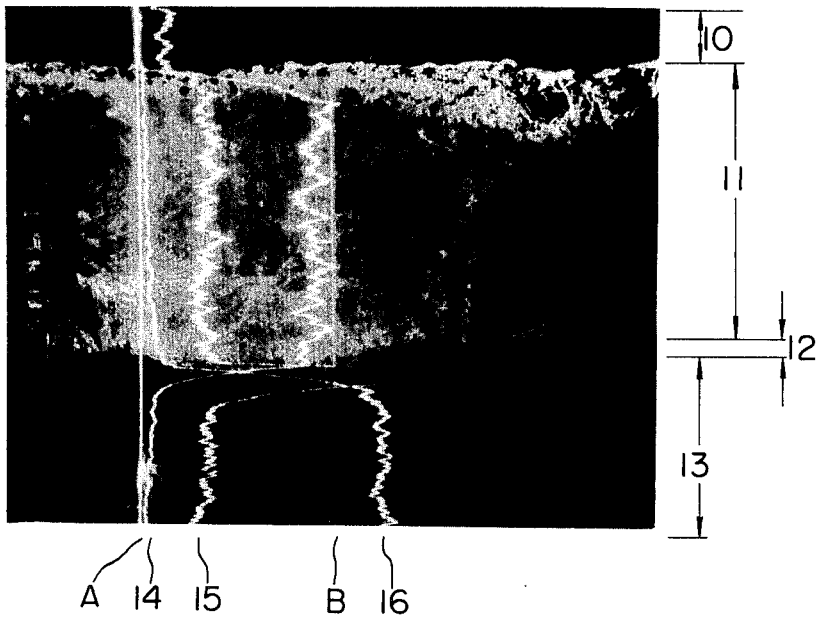
FIG. 1 is a view obtained by EMX of the element distribution of a conventional galvanized steel sheet manufactured by a conventional galvanizing method.

The present invention relates to a galvanized steel sheet of zero-spangle having a zinc coating on at least one side of the sheet which zinc coating consists of less than 0.1–0.2 wt% Al, 0.1–0.5 wt% Sb, the remainder being Zn, and unavoidable impurities, the total of the unavoidable impurities other than Fe, namely Pb, Cd and Sn, being less than 0.02 wt% and the ratio of Sb/Pb being 10–250, and which includes an Al-Sb eutectic.

This invention is characterized in that a steel sheet is hot-dipped in a molten coating bath consisting of 0.1 to less than 0.2 wt% Al, 0.1–0.5 wt% Sb, and the remainder of Zn and unavoidable impurities, the total of the unavoidable impurities other than Fe, namely Pb, Cd and Sn, being less than 0.02 wt% and the ratio of Sb/Pb being 10–250, and is thereafter immediately subjected to a zero-spangle treatment, whereby a galvanized steel sheet of zero-spangle is obtained.

The gist of the invention lies in the exclusion from the composition of a molten coating bath of any element which causes the coating layer to flake during long-term indoor aging of the galvanized steel sheet. Of such injurious elements, Pb shows a spangle development and has an injurious action on the coating layer; and other impurities such as Al, Cd and Sn cause the Zn of the coating layer to assume the role of an anode in local electrolytic activity and thus promote corrosion of Zn. Accordingly, it is required that injurious elements should be excluded from the molten bath as much as possible, and Sb is added in place of Pb in order to promote a spangle development.

The unavoidable impurities contained in zinc referred to above are specified in ASTM B-6 as being 0.007 wt% Pb and 0.004 wt% Cd.

In this invention, the inclusion of less than 0.1 wt% Al is not desirable because it impedes the formation of a uniform and continuous layer of an Fe-Al-Zn ternary alloy which is necessary for maintaining the initial adherence of the coating layer to the steel sheet, and further, it promotes the growth of a layer of an Fe-Zn binary alloy which exhibits brittleness during working; and more than 0.2 wt% Al is not also desirable because the amount of Al liberated in the coating layer increases so much that it promotes both the propagation of corrosion at crack regions and also the embrittlement of the coating layer during long-term indoor aging. Accordingly, 0.1–0.15 wt% Al is most preferred.

Next, if less than 0.1 wt% Sb is present, it causes the same adverse effects as the other impurities in the coating bath, namely Pb, Cd and Sn, and besides, it also promotes the occurrence of cracks in the coating layer due to the quenching treatment for making a zero-spangle as well as the flaking phenomenon of the coating layer during long-term indoor aging; and, furthermore, it is not desirable because the development of a coating spangle becomes insufficient so that it becomes difficult to realize selective formation of spangles in the same coating bath and to obtain a smooth and beautiful appearance by a zero-spangle treatment according to the conventional method described hereinafter.

If the amount of Sb exceeds 0.5 wt%, the amount of the coating adhering to the steel sheet increases owing to the increased viscosity of the coating bath so that the amount of the coating is hard to control by the gas wiping method of a high speed continuous processing line. Besides, no matter how the quenching method for producing the zero-spangle pattern is carried out, it is difficult to obtain a coating having a sufficiently minimum spangle.

Further, the appearance of the spangle coating obtained by natural cooling exhibits a distinctly uneven surface which can be detected by the finger. Such a large-spangled galvanized steel sheet is susceptible to scratch scarring and is, therefore, of low commercial value.

Accordingly, 0.15–0.3 wt% Sb is preferred in order to maintain both stable good quality and line processing operation.

Next, if the total amount of unavoidable impurities other than Fe, namely Pb, Cd and Sn, is more than 0.02 wt%, it promotes the occurrence of cracks in the coating layer in the quenching treatment for obtaining zero-spangle and it also increases the local electrolytic activity with Zn so that the propagation of the cracks due to a local corrosion is accelerated during long-term indoor aging to speed up embrittlement of the coating layer. Therefore, the impurities should be excluded as much as possible. Thus the total amount of unavoidable impurities is preferred to be less than 0.01 wt%.

In addition, if the ratio of Sb/Pb is less than 10, damage to the coating layer by Pb cannot be obviated. On the contrary, if the ratio of Sb/Pb exceeds 250, an uneven coating tends to result, lowering the commercial value of the article. Therefore, the ratio of Sb/Pb is preferred to be 40–200.

Since the viscosity of the molten bath in this invention tends to increase owing to the addition of Sb to the molten coating bath as described hereinbefore, the temperature of the bath should be controlled to the high temperature side, namely, to within the range of 450°–480° C., which allows easy control of the amount of a coating adhering to the steel sheet so that coatings of consistent appearance are obtained.

However, if the bath temperature exceeds 480° C., the corrosive action of the molten bath on the galvanizing equipment including the galvanizing stand becomes so great that the equipment is damaged.

In the zero-spangle process, there are known various methods involving, for example, the blowing of a cold wind or the spraying of water or the mist of an aqueous solution of an inorganic phosphate. Although any of these processes may be applied in this invention, the use of an aqueous solution of an inorganic phosphate for example $Na_2HPO_4$ or $NH_4H_2PO_4$ is preferred because its greater decomposition latent heat makes it possible to obtain a zero-spangle coating with excellent appearance.

In the application of the molten bath comprising the composition of this invention, when the selective formation of a large or minimum spangle is desired, more particularly, when it is desired to obtain a zero-spangled coating with a smooth surface and having a spangle that is exceedingly fine, it is required that a proper cooling speed should be used for cooling the coated steel sheet in order to achieve the semi-molten state of the molten zinc coated surface of the steel sheet while, on the other hand, the spray requirements such as spray pressure, volume of flow, size of the spray particles, and particle density should be satisfied.

A cooling speed of 100°–300° C./sec. for the steel sheet is preferred for the molten bath system of this invention. If the cooling speed is less than 100° C./sec., Al and Sb, both of which are components added to the molten bath, are concentrated toward the non-solidified zinc in the course of non-equilibrium crystallization to reduce the temperature of equilibrium so that supercooling is weakened to retard crystallization. This means that it will not be possible to attain the desired minimum spangle.

On the other hand, however, if the cooling speed exceeds 300° C./sec., there is a decrease in the migration phenomenon by which the concentration of components added to the molten bath is shifted to the non-solidified zinc, and the molten zinc is instantly solidified to form a minimum spangle. As a result, depending on the spray requirement of the solution using for zero-spangle, a crater-like pitting tends to form so that the commercial value of the galvanized steel sheet is exceedingly lowered. The cooling speed for cooling the steel sheet is preferred to be 150°–250° C./sec.

The coating layer of the zero-spangle galvanized steel sheet obtained according to this invention, does not suffer from cracks occurring during the coating process and is totally free from crack enlargement and propagation during the long-term indoor aging. Accordingly, no flaking takes place at all. The coating thus exhibits excellent resistance to flaking of the coating during the long-term aging.

The inventors analyzed the remarkable effect mentioned above using an electron microscope (referred to as an SEM hereinafter), EMX and the X-ray diffraction method.

In consequence, as clearly shown in the composite diagram of SEM and EMX of FIG. 1, it is seen that Al which exists in the coating layer of a zero-spangle galvanized steel sheet to which Sb is not added (corresponding to Sample No. 21 of Example, Table 1) is liberated and distributed over all parts of the coating layer except the alloy layer at a nearly constant concentration.

Figure 2:
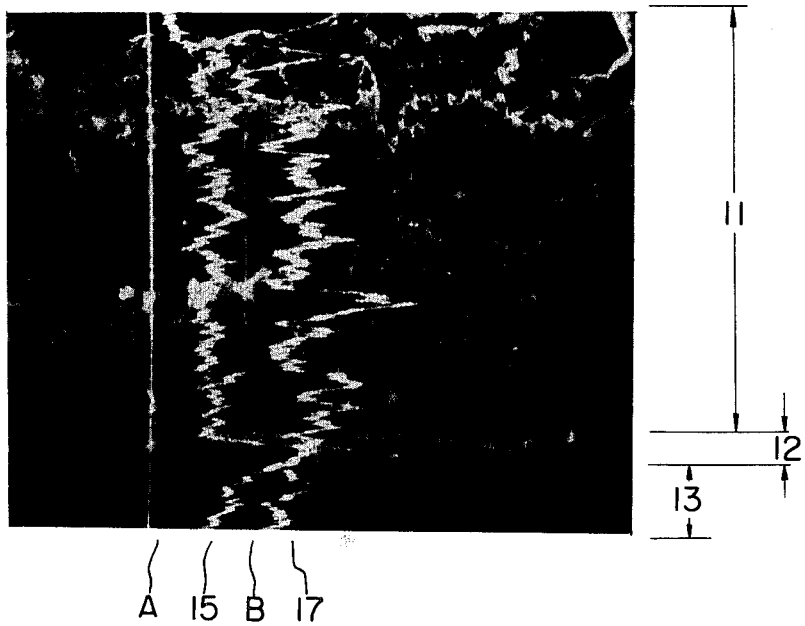
FIG. 2 is a view obtained by EMX of the element distribution of a novel galvanized steel sheet manufactured by the method of the present invention.
Figure 3:
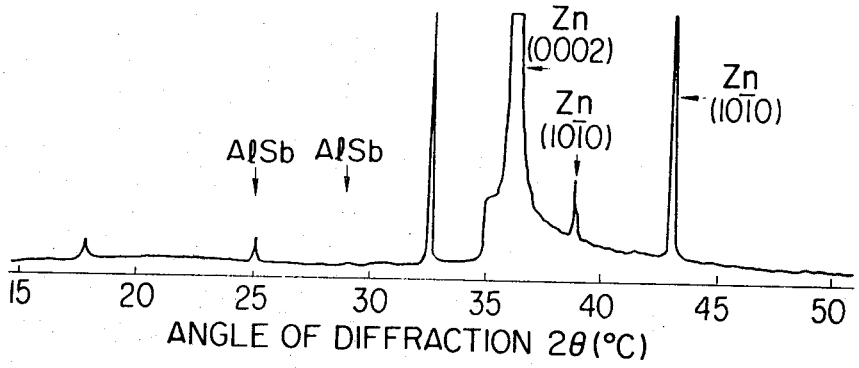
FIG. 3 is a view obtained by X-ray diffraction of a galvanized steel sheet manufactured in accordance with the method of this invention.

On the contrary, however, in the coating layer to which Sb is added in accordance with the teachings of this invention (corresponding to Sample No. 20, Example, Table 1), it is seen as shown in FIG. 2 that Sb coexists with Al in almost the same distribution pattern as that of Al. Moreover, it was found as indicated in the results of X-ray diffraction of FIG. 3 that the coexistence of Al-Sb is an Al-Sb eutectic.

FIG. 1 and FIG. 2 show an inclination of 10 degrees and a magnification of ×300, and further, a resinous layer 10, a hot-dip galvanized coating 11, an Fe-Al-Zn alloy layer 12, a steel sheet 13, ZnKα14, AlKα15, FeKα16, SbKα17, a base line A, and a position of measurement B, respectively.

It is considered that the above remarkable effect of Sb on the resistance of a coating to flaking during an aging period is attributable to the fact that the corrosive potential toward cathodic direction of Al is shifted by the presence of Al in the coating layer as an Al-Sb eutectic, whereby the effectiveness of Sb is exhibited by the inhibition of corrosion of Zn.

As fully described in the foregoing, in accordance with the method of the present invention, choice of a galvanized steel sheet having a different size of a spangle particle can be effected using the same hot-dip galvanizing bath, whereby a zero-spangle galvanized steel sheet which is an epoch-making and unprecedented novel article of manufacture having an excellent resistance to coating exfoliation during long-term indoor aging and a method for manufacturing the same are provided.

An example in accordance with the present invention will be described hereinbelow.

EXAMPLE

Figure 4:
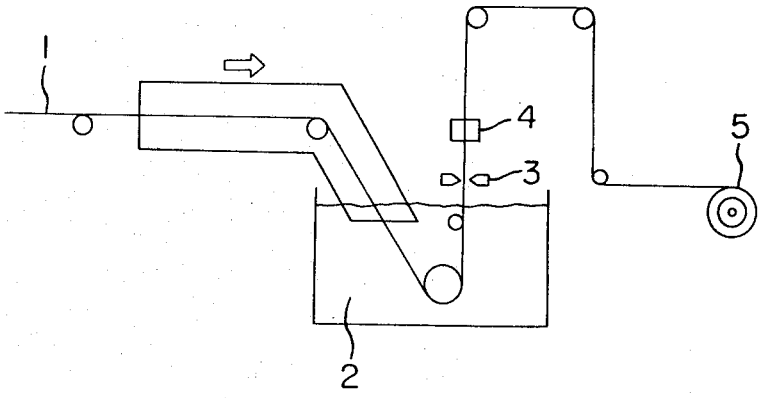
FIG. 4 is a schematic view showing a continuous processing line used for this invention.

In a hot-dip continuous galvanizing processing line of the Sendzimir type shown in FIG. 4, a low carbon steel strip 1 of 0.27 mm thick and 914 mm wide was passed through a non-oxidize annealing furnace at a line speed of 150 m/min. with a specified annealing cycle, and then, immersed in a hot-dip galvanizing pot 2 having a controlled specified bath composition at a bath temperature of 470°–475° C. Immediately, the amount of coating was controlled to a specified amount by a gas wiping apparatus 3, and the surface of the semi-molten zinc coating was subjected to a spraying step by a spraying apparatus 4 in which an aqueous solution of an inorganic phosphate ($Na_2HPO_4$ or $NH_4H_2PO_4$) was sprayed in the form of mist to produce a zero-spangle thereon, and then the galvanized strip was coiled by a recoiler 5.

The results of the above processing are shown in Table 1.

In Table 1, it is seen that Sample Nos. 2, 3, 10, 11, 12, 17, 18, 19 and 20 of the zero-spangle galvanized steel sheet manufactured in accordance with the method of this invention exhibit far more excellent resistance to coating flaking during long-term indoor aging than do samples Nos. 1, 4, 5, 6, 7, 8, 9 and 13–16. Sample No. 21 is a comparison one manufactured by the conventional method in which Sb is not added to the molten coating bath.

TABLE 1

| Sample No. | | Composition of Coating Bath (wt %) Al | Sb | Pb | Zn* | Sb/Pb ratio | Z.C.S. | Resistance to Coating Flaking During Aging** |
|---|---|---|---|---|---|---|---|---|
| 1 | Comparison | 0.05 | 0.20 | 0.017 | Remainder | 10 | 150 | X |
| 2 | This invention | 0.10 | 0.20 | 0.016 | " | 10 | 175 | ⊙ |
| 3 | " | 0.15 | 0.20 | 0.015 | " | 10 | 200 | ⊙ |
| 4 | Comparison | 0.20 | 0.20 | 0.015 | " | 10 | 183 | Δ |
| 5 | " | 0.30 | 0.20 | 0.015 | " | 10 | 195 | Δ |
| 6 | " | 0.15 | 0.20 | 0.20 | " | 1 | 250 | X-Δ |
| 7 | " | 0.15 | 0.20 | 0.10 | " | 2 | 180 | X-Δ |
| 8 | " | 0.15 | 0.20 | 0.05 | " | 4 | 170 | X-Δ |
| 9 | " | 0.15 | 0.20 | 0.03 | " | 7 | 150 | Δ |
| 10 | This invention | 0.15 | 0.20 | 0.01 | " | 20 | 222 | ⊙ |
| 11 | " | 0.15 | 0.20 | 0.005 | " | 40 | 105 | ⊙ |
| 12 | " | 0.15 | 0.20 | 0.002 | " | 100 | 123 | ⊙ |
| 13 | Comparison | 0.15 | 0 | 0.002 | " | 0 | 295 | Δ-o |
| 14 | " | 0.15 | 0.01 | 0.002 | " | 5 | 283 | Δ |
| 15 | " | 0.15 | 0.05 | 0.002 | " | 25 | 250 | Δ |
| 16 | " | 0.15 | 0.10 | 0.002 | " | 50 | 210 | Δ-o |
| 17 | This invention | 0.15 | 0.15 | 0.002 | " | 75 | 211 | ⊙ |
| 18 | " | 0.15 | 0.20 | 0.002 | " | 100 | 185 | ⊙ |
| 19 | " | 0.15 | 0.30 | 0.002 | " | 150 | 170 | ⊙ |
| 20 | " | 0.15 | 0.50 | 0.002 | " | 250 | 153 | ⊙ |
| 21 | Conventional | 0.25 | 0 | 0.20 | " | 0 | 50 | X |

Note:
*containing 0.005 wt % of unavoidable impurities other than Fe.
Z.C.S.: Zero-spangle treatment cooling speed (°C./sec.)
**Indoor aging
pH 65–85%, room temperature 3°–36° C. 36 months. After the chromate treatment, the sheet is subjected to tape adhesion test by DuPont. shock 1 kg × 50 cm.
⊙No flaking of coating at all.
o Coating flaking occurs very little.
Δ Coating flaking occurs considerably.
X Coating flaking occurs all over the surface (from the steel sheet).

We claim:

1. An improved zero-spangle galvanized steel sheet having excellent resistance to age-flaking of its galvanized coating comprising a steel sheet provided at least on one side thereof with a hot-dip galvanized coating of a novel composition consisting of 0.1 to less than 0.2 weight % Al, 0.1–0.5 weight % Sb, unavoidable impurities including Pb, Cd and Sn but not including Fe in a total amount of less than 0.02 weight % and the remainder Zn, the ratio of Sb/Pb in said coating being 10–250, and the Al existing in said coating being present as an Al-Sb eutectic.

2. An improved hot-dip galvanizing bath comprising 0.1 to less than 0.2 weight % Al, 0.1–0.5 weight % Sb, unavoidable impurities including Pb, Cd and Sn but not including Fe in a total amount of less than 0.2 weight % and the remainder Zn, the ratio of Sb/Pb in said bath being 10–250.

3. An improved hot-dip galvanizing bath as claimed in claim 2 which contains 0.1–0.15 weight % Al.

4. An improved hot-dip galvanizing bath as claimed in claim 2 which contains 0.15–0.3 weight % Sb.

5. An improved hot-dip galvanizing bath as claimed in claim 2 in which the total amount of unavoidable impurities including Pb, Cd and Sn but not including Fe is less than 0.01 weight %.

6. An improved hot-dip galvanizing bath as claimed in claim 2 in which the ratio of Sb/Pb is 40–200.

7. A method for the manufacture of a zero-spangle hot-dip galvanized steel sheet having excellent resistance to an age-flaking of said galvanized coating which comprises the steps of hot-dipping a steel sheet in a hot-dip galvanizing bath consisting of 0.1 to less than 0.2 weight % Al, 0.1–0.5 weight % Sb, unavoidable impurities including Pb, Cd and Sn but not including Fe in a total amount of less than 0.02 weight %, the ratio of Sb/Pb being 10–250, and the remainder Zn, and subsequently processing said hot-dipped steel sheet by a zero-spangled treatment.

8. A method for the manufacture of a zero-spangle hot-dip galvanized steel sheet as claimed in claim 7 in which said hot-dip galvanizing bath contains 0.1–0.15 weight % Al.

9. A method for the manufacture of a zero-spangle hot-dip galvanized steel sheet as claimed in claim 7 in which said hot-dip galvanizing bath contains 0.15–0.3 weight % Sb.

10. A method for the manufacture of a zero-spangle hot-dip galvanized steel sheet as claimed in claim 7 in which said hot-dip galvanizing bath contains unavoidable impurities including Pb, Cd and Sn but not including Fe in a total amount of less than 0.01 weight %.

11. A method for the manufacture of a zero-spangle hot-dip galvanized steel sheet as claimed in claim 7 in which the ratio of Sb/Pb in said galvanized bath is 40–200.

12. A method for the manufacture of a zero-spangle hot-dip galvanized steel sheet having excellent resistance to age-flaking of said galvanized coating as claimed in claim 7 in which, in the course of cooling said molten galvanized coating, said coating is subjected to a zero-spangle quenching treatment while the cooling speed of said steel is maintained at 100°–300° C. per second.

13. The zero-spangle galvanized sheet produced by the method of claim 7.

* * * * *